United States Patent [19]

Bran

[11] Patent Number: 5,037,481

[45] Date of Patent: Aug. 6, 1991

[54] MEGASONIC CLEANING METHOD

[75] Inventor: Mario E. Bran, Garden Grove, Calif.

[73] Assignee: Verteq, Inc., Anaheim, Calif.

[21] Appl. No.: 482,086

[22] Filed: Feb. 15, 1990

Related U.S. Application Data

[63] Continuation of Ser. No. 272,501, Nov. 6, 1988, Pat. No. 4,998,549, which is a continuation-in-part of Ser. No. 144,515, Jan. 15, 1988, Pat. No. 4,869,278, which is a continuation-in-part of Ser. No. 43,852, Apr. 29, 1987, Pat. No. 4,804,007.

[51] Int. Cl.[5] ..... B08B 9/00

[52] U.S. Cl. ..... 134/1; 134/105; 134/184; 134/201

[58] Field of Search ..... 134/1, 105, 184, 201; 366/127; 310/340, 348

[56] References Cited

U.S. PATENT DOCUMENTS

| | | |
|---|---|---|
| 2,498,737 | 2/1950 | Holden . |
| 2,828,231 | 3/1958 | Henry . |
| 2,831,785 | 4/1958 | Kearney . |
| 2,950,725 | 8/1960 | Jacke et al. . |
| 3,058,014 | 1/1962 | Camp . |
| 3,151,846 | 10/1964 | George . |
| 3,301,535 | 1/1967 | Brown . |
| 3,396,286 | 8/1968 | Anderson et al. . |
| 3,415,548 | 12/1968 | Goodman et al. . |
| 3,517,226 | 6/1970 | Jones, Sr. . |
| 3,596,883 | 8/1971 | Brech . |
| 3,730,489 | 5/1973 | Morita . |
| 3,873,071 | 3/1975 | Tatebe . |
| 3,893,869 | 7/1975 | Mayer et al. . |
| 4,099,417 | 7/1978 | Shwartzman . |
| 4,118,649 | 10/1978 | Shwartzman et al. . |
| 4,326,553 | 4/1982 | Hall . |
| 4,385,255 | 5/1983 | Yamaguchi et al. . |
| 4,440,025 | 4/1984 | Hayakawa et al. . |
| 4,543,130 | 9/1985 | Shwartzman . |
| 4,602,184 | 7/1986 | Meitzler . |
| 4,644,214 | 2/1987 | Takamizawa et al. . |
| 4,670,683 | 6/1987 | T'Hoen . |

*Primary Examiner*—Asok Pal

*Attorney, Agent, or Firm*—Knobbe, Martens, Olson and Bear

[57] ABSTRACT

A transducer array for use in a megasonic cleaning system including a transmitter element made of a material which will efficiently transmit megasonic energy when bonded to one conductive surface of a transducer. In one form, the transmitter and the transducer are flat plates. In another form, a flat transducer is bonded to a solid semi-cylindrical transmitter which causes the megasonic energy pattern to diverge. In another form, the transmitter is a semi-cylindrical shell or is tubular, and the transducer is bonded to and curved to conform to the transmitter. The transducer extends about 120°, and produces a straight line of sight diverging energy pattern.

6 Claims, 4 Drawing Sheets

16
20
18
18
14
12
10

22
32
28
34
24
30
34
60
24
26
12
5
36

22
5
26

46
36
50
51
44
6
51
48
58
6
42
54
22
46
50
36
38
42
44
24
24
60

50
36
46
44
54
58

MEGASONIC CLEANING METHOD

RELATED APPLICATION

This is a continuation of U.S. patent application Ser. No. 272,501, filed Nov. 16, 1988, now U.S. Pat. No. 4,998,549, which is a continuation-in-part of application Ser. No. 144,515, filed Jan. 15, 1988, now U.S. Pat. No. 4,869,278, which is a continuation-in-part of application Ser. No. 043,852, filed Apr. 29, 1987, now U.S. Pat. No. 4,804,007.

FIELD OF THE INVENTION

This invention relates to a method for cleaning semiconductor wafers or other such items requiring extremely high levels of cleanliness.

BACKGROUND OF THE INVENTION

U.S. Pat. No. 3,893,869 discloses a cleaning system wherein very high frequency energy is employed to agitate a cleaning solution to loosen particles on the surfaces of semiconductor wafers. Maximum cleanliness is desired in order to improve the yield of acceptable semiconductor chips made from such wafers. This cleaning system has become known as megasonic cleaning, in contrast to ultrasonic cleaning, in view of the high frequency energy employed. Ultrasonic cleaners typically generate random 20–40 kHz sonic waves that create tiny cavities in a cleaning solution. When these cavities implode, tremendous pressures are produced which can damage fragile substrates, especially wafers. Megasonic cleaning systems typically operate at a frequency over 20 times higher than ultrasonics, and consequently they safely and effectively remove particles from materials without the side effects associated with ultrasonic cleaning.

A number of improvements have been made to this system as initially outlines in the above-referenced patent, and several companies are now marketing such cleaning apparatus. One of these is Verteq, Inc. of Anaheim, Calif., the assignee of the invention disclosed and claimed in this document. One of the major improvements that helped make the product a commercial reality concerns the design of the transducer array which converts electrical energy into sound waves for agitating the cleaning liquid. The transducer is perhaps the most critical component of the megasonic cleaning system. The transducer array which has been developed and has been marketed by Verteq for a number of years is mounted on the bottom of the process tank close to the components to be cleaned so as to provide powerful particle removal capability. The transducer array includes a strong, rigid frame suitable for its environment, and in one form includes a very thin layer of tantalum, which is a ductile, acid-resisting metallic element, spread over the upper surface of the frame.

A pair of spaced rectangular ceramic transducers are positioned within a space in the plastic frame and bonded by electrically conductive epoxy to the lower side of the tantalum layer extending over the space in the frame. The transducer has a coating of silver on its upper and lower faces that form electrodes. RF (radio frequency) energy approximately 800 kHz is applied to the transducer by connecting one lead to the lower face of the transducer and by connecting the other lead to the layer of tantalum which is electrically conductive and which is in electrical contact with the upper silver coating of the transducer.

While megasonic cleaning systems employing this transducer array have enjoyed commercial success, improvements have been made recently wherein materials more durable than tantalum have been used for transmitting the megasonic energy. Such improvements are set forth in the above referenced U.S. patent application Ser. No. 043,852. In a preferred form of that invention, the transmitting material is in the form of a quartz or sapphire plate to which the transducers are bonded by a suitable epoxy which need not be electrically conductive.

In using megasonic cleaning apparatus of the types discussed above, a cassette of semiconductor wafers is typically immersed in a cleaning solution in a container, with the transducer array being mounted in the bottom wall of the container. The wafer carried usually has an elongated rectangular opening in its bottom wall and it includes a structure forming a series of slots which engage the side lower edge portions of the wafers to support the wafers in spaced, substantially parallel relation, with the wafers being oriented substantially vertically. The megasonic energy is thus transmitted upwardly through the opening in the carrier to adjacent portions of both faces of the wafers to loosen contaminating particles on the surface of the wafers. To increase the exposure of the surfaces of the wafers to the megasonic energy, the carriers are moved transversely across the upwardly extending generally rectangular beam of megasonic energy.

While this approach is widely used, it has shortcomings. From a cleaning standpoint, it is difficult to adequately expose the flat edge portions of the wafers to the megasonic energy in view of the carrier structure that extends between the megasonic energy pattern and the edge portions of the wafers. Also, apparatus is needed for moving the carrier back and forth within the container, together with controls for controlling the rate and duration of the movement. Both the moving apparatus and the controls add considerably to the expense of the apparatus. Further, since the container must be sufficiently large to accommodate this movement of the carrier, container expense is significant, and more importantly, it is necessary to provide sufficient cleaning solution within the container, and the solutions needed are expensive.

Perhaps even a more important undesirable aspect of this arrangement is that the moving apparatus may generate particles of its own which can contaminate the wafers. Steps to minimize this possible source of contamination adds further to the expense of the apparatus. Also, it is in general desirable to minimize movement of wafers and thus minimize the risk of damage or breakage. Breakage, of course, further reduces the acceptable product yield obtained from the wafers, and adds to the cost of the acceptable products.

For all the foregoing reasons, a need exists for further improvements in megasonic cleaning methods. More specifically, it is desirable to: (1) do a better job of cleaning the wafers; (2) eliminate the need to move the wafers during the cleaning operation; (3) reduce the size of the cleaning container relative to the size of wafer carrier; (4) reduce the volume of cleaning solutions needed; and (5) thereby reduce the cost of the magnetic cleaning apparatus and the cost of the processed products. It is also desirable to maximize the effective energy output of the apparatus for a given space or envelope.

SUMMARY OF THE INVENTION

Briefly stated, the invention comprises a static megasonic cleaning system utilizing a transmitting device in the wall of a container for transmitting megasonic energy in a diverging or diffusing pattern into cleaning solution in the container. This will enable the energy to enter an elongated opening in the bottom of a wafer carrier in a diverging manner to subject the entire area of both flat surfaces of each wafer to the megasonic energy without having to move the carrier during the process. Such a static system satisfies the above-listed desires.

More specifically, the system uses a transducer bonded to a lens or transmitter having a surface facing the interior of the container which is adapted to diffuse or direct the megasonic energy into a desired diverging pattern. In one form of the invention, the transmitter or lens has an elongated generally semi-cylindrical shape, and the convex side faces the interior of the container. A flat plate-like transducer is bonded to the flat side of the lens, and the lens is mounted in the bottom wall of the container in a fluid-tight manner. Megasonic energy applied to the transducer is thereby transmitted through the lens into the container. For ease of mounting the lens in the wall of the container, there is provided a frame bonded to the lens in an area surrounding the flat face of the lens. The transducer is thus positioned within the frame. The frame is then secured by suitable fastening means to the bottom wall of the container with the lens being in the opening and extending into the container.

The lens is made of a material which efficiently transmits megasonic energy and does not react with the cleaning solutions employed and form contaminates. Preferred materials are quartz or sapphire, although other materials are being evaluated. Preferably, the frame is rigidly bonded to the lens and is made of material like that of the lens.

To enhance the amount of energy which can be applied to the transducers, spray nozzles are provided for spraying a coolant onto the transducer. Since the lens is an electrical insulator, the high potential side of the transducer can be bonded to the lens, thus permitting coolant to be sprayed on the grounded side without creating an electrical hazard. A cavity or compartment for confining this spraying activity is formed around the transducer, and the compartment walls are used to attach to the frame to the container. A drain in the lower portion of this cavity allows the coolant to be ducted away from the electrically energized transducer.

In a preferred form of the invention, both the transmitter and the transducer are arcuate, preferably in the form of a cylindrical segment. A convex surface of the transducer is bonded to a concave surface of the transmitter, and the megasonic energy is transmitted through the transmitter in a straight line but diverging pattern to cover both surfaces of wafers to be cleaned. Such an arrangement more than doubles the effective energy output in relation to the solid lens approach. The transmitter may conveniently be semi-cylindrical or tubular. In one tubular form, the ends extend through and are mounted to the walls of a cleaning container. In another form, the ends of the tube are closed and the transducer array is totally immersed in the cleaning solution.

In accordance with the method of the invention, semi-conductor wafers or other such elements are cleaned utilizing megasonic energy, wherein the method includes bonding an elongated transducer to a surface of an elongated transmitting device, with the device having a surface on the side opposite that of the transducer to direct megasonic energy in a diverging pattern. Thus when megasonic energy is applied to the transducer, it transmits the energy to the device and causes it to transmit the megasonic energy in this desirable diverging pattern. The significant advantage of this is that all surfaces of a group of wafers positioned in a carrier can be subjected to the cleaning megasonic energy without having to move the wafers or the transmitter. This provides the various benefits discussed above.

SUMMARY OF THE DRAWING

FIG. 1 is a schematic perspective view of the megasonic cleaning apparatus.

FIG. 2 is an enlarged perspective view of the transducer array of FIG. 1.

FIG. 3 is an enlarged perspective view of a portion of the transducer array of FIG. 2.

FIG. 4 is an enlarged perspective view of a portion of the transducers and the mounting plates taken from below the transducer array.

FIG. 5 is a cross-sectional view of the transducer array on line 5—5 of FIG. 2.

FIG. 6 is a cross-sectional view of a transducer and a transducer mounting plate illustrating the electrical connection for the transducer.

DETAILED DESCRIPTION OF THE DISCLOSURE

Figures 1, 2, 3, 4, 5, 6:
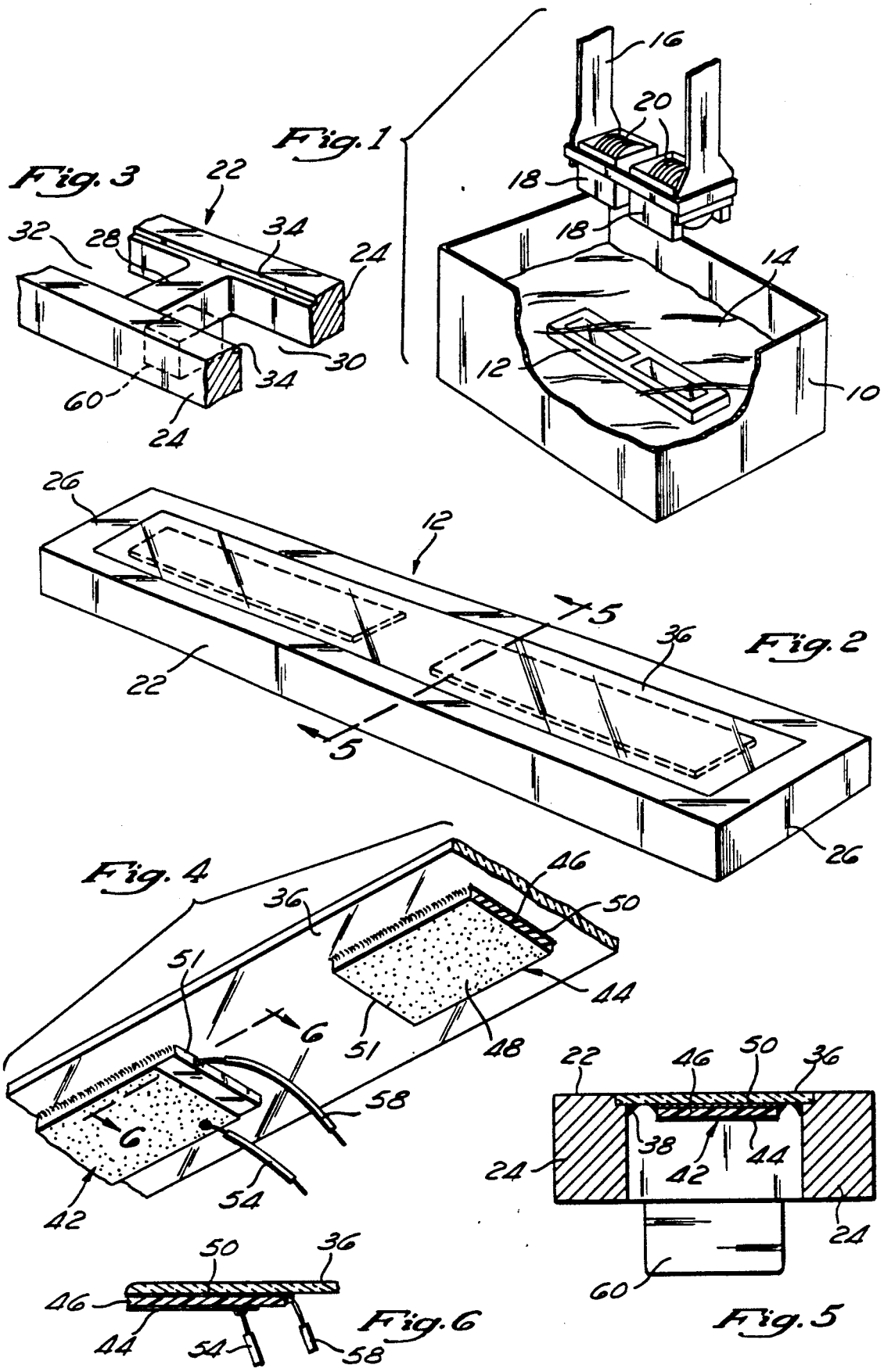
FIGS. 1-6 disclose as background material the invention set forth in the above-identified U.S. application Ser. No. 043,852, filed Apr. 29, 1987.

FIG. 1 schematically illustrates a container 10 as a portion of a megasonic cleaning system. A transducer array 12 is mounted in the bottom wall of the container 10. Cleaning solution 14 is positioned in the container above the upper surface of the transducer array 12. A cassette holder 16 is schematically illustrated above the container, with the holder supporting a pair of cassettes 18 carrying semiconductor wafers 20.

The details of the container and the holder are not needed for an understanding of the arrangement of FIGS. 1–6, which concerns the transducer array. Further, a complete megasonic cleaning apparatus includes many other components such as the plumbing for introducing and removing cleaning solutions, and electrical control components for programming and controlling the various wash and rinse operations. Additional information about such a system may be obtained from Verteq, Inc. of Anaheim, Calif., a manufacturer of such equipment.

Referring to FIGS. 2–6, the transducer array 12 includes an elongated, rectangular supporting frame 22 having a pair of elongated side portions 24, a pair of shorter end portions 26, and a central supporting rib 28 that extends parallel to the end portions 26. These portions, together with the rib, define a pair of elongated, rectangular openings 30 and 32. The inner walls of the side and end portions 26 and 28 are formed with a recess 24 that extends completely around the interior perimeter of the windows 30 and 32. The upper surface of the central rib 28 is flush with the recess.

An elongated, rectangular transducer plate 36 is positioned on the frame 22 with its edges precisely fitting within the recessed area so that the transducer plate is firmly and positively supported by the frame 22. The transducer plate is securely maintained in this position by a suitable epoxy applied to the frame recessed area and the upper surface of the rib 28. As indicated in FIG. 5, some epoxy 38 may be applied to the joint corner formed by the lower surface of the transducer plate 36 and the surrounding side wall portions 24 of the frame.

Attached to the lower surface of the transducer plate is a pair of flat, elongated transducers 42 and 44, one of which is centrally positioned in the elongated opening 32 and the other of which is centrally positioned in the opening 30. These transducers are bonded to the plate 36 by a suitable epoxy. Each transducer includes a main body 46 which is in the form of a polarized piezoelectric ceramic material with an electrically conductive coating 48 on its lower surface and an electrically conductive coating 50 on its upper surface. The coating on the upper surface extends onto one end 51 of the transducer which is positioned adjacent to the rib 28. The coating 48 terminates a short distance from that end of the transducer, as may be seen in FIG. 4, so that the electrode coatings are suitably spaced from each other.

An electrical conductor 54 is welded or otherwise suitably connected to the lower electrode, and the other conductor 58 is welded or otherwise suitably connected to the portion of the upper electrode which is conveniently accessible on the end of the transducer. These conductors are connected to an electrical component 60 shown schematically in FIGS. 3 and 5, with such components in turn being connected to the balance of the apparatus for providing a suitable supply (not shown) or megasonic energy.

In accordance with the invention, the transmitter is preferably made of polished quartz for use with most cleaning solutions. A few solutions cannot be used with quartz, such as one containing hydrofluoric acid which will etch quartz. Another desirable material is sapphire which is suitable for either acidic or non-acidic solutions. Since it is more expensive than quartz, it is more practical to use sapphire only for that apparatus in which solutions are to be used which are incompatible with quartz. The plate 36 may also be made of other materials having characteristics similar to quartz or sapphire. Another example of a suitable material is boron nitride.

A primary requirement of the plate material is that it must have the mechanical elasticity and other necessary characteristics to efficiently and uniformly transmit the megasonic energy. Further, the material must be available in a form to have a smooth surface so as to be easily bonded to the transducer with a uniform layer of bonding material and without the tendency to develop hot spots. Since both quartz and sapphire are dielectric, a conductive epoxy is not required, which is good in that bonding is easier with a non-conductive epoxy. On the other hand, a thermally conductive bonding material is desirable to help dissipate heat away from the transducer so as to minimize the possibility of bubbles expanding in the bonding layer.

Another requirement is that the plate material be relatively strong and durable mechanically so that it can withstand usage over many years and does not mechanically erode as a result of the mechanical vibration. A homogeneous molecular structure with molecular elasticity is desired. Related to this, the material must also be able to withstand temperature variations without mechanical failure.

Also related to the mechanical strength is the thickness of the plate, which in turn is related to the vibrational characteristics of the material. With some materials, such as tantalum, the desired vibrational characteristics for transmitting megasonic energy are only obtained with thin layers, and this in turn introduces the strength aspects.

Naturally, the material must be such that it does not contaminate the cleaning solutions employed. Conversely, it must be able to withstand the cleaning solutions.

Plain glass for the plate is satisfactory as a transmitter of the megasonic energy in situations in which chemical contamination is not critical, such as cleaning glass masks, ceramic substrates or some computer discs. On the other hand, glass is not satisfactory for high purity situations, such as in cleaning semiconductors. Silicon may also be acceptable for some applications, but in the past, it has not been practical to obtain an acceptable silicon plate of the desired size.

As noted above, the electrical energy applied to the transducer array must be matched with the materials employed and the thickness of the plate. For a quartz plate of about 0.80 inch with two transducers bonded thereto, each having an upper surface area of about 6 square inches, satisfactory results have been obtained with a 400 watt beam of RF energy at 850–950 kHz. It is believed that with a quartz plate, satisfactory results can be obtained with thickness ranging from 0.030 to 0.300 inch with megasonic energy ranging from 3000 kHz to 300 kHz, the higher frequency being used with the thinner material. For the sapphire plate, a similar thickness range is acceptable with 1000 kHz energy, with a 0.060 inch thick plate being preferable.

The actual wattage is related to the size of the plate. Watt density is a more meaningful measure, and a density range of 20 to 40 $w/in^2$ being satisfactory, and 25 being most preferable. A watt density of 40 $w/in^2$ may require cooling on the lower side of the plate to prevent hot spots from forming.

As mentioned, the thickness of the plate used is related to its resonant frequency with the megasonic energy employed. Since more than one transducer is preferably used in an array and the transducers seldom have perfectly matched resonant frequencies, it is necessary to adjust the frequency to best balance the characteristics of the plate and the transducers. Thus, the frequency employed is not necessarily the precise resonant frequency, or fraction or multiple thereof, for the plate. Instead, tuning or adjusting is employed to attain the operating point at which the maximum energy transfer is obtained.

With a system planned for production, two 1-inch by 6-inch flat transducers are employed, mounted in spaced end-to-end relation on a plate about 1.75 inches wide and almost 14 inches in length. Of course, a wide variety of plate shapes and sizes may be employed consistent with thickness, strength and ability to efficiently transmit megasonic energy.

Figure 7:
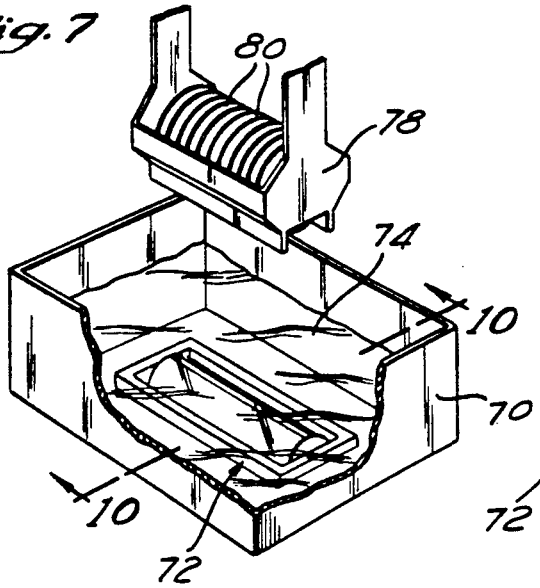
FIG. 7 is a schematic perspective view of the cleaning apparatus of the present invention.

Referring to FIG. 7, there is disclosed a container 70 having a transducer array 72 mounted in the bottom wall 71 of the container. Cleaning solution 74 is positioned in the container above the upper surface of the transducer array. A cassette 78 carrying a plurality of semiconductor wafers 80 is schematically illustrated above the container in position to be placed into the container or be removed from the container. The cassette is to represent any of the well-known cassettes having support structure which forms a plurality of slots for supporting the wafers in spaced, substantially parallel relation, and with the wafers substantially vertically oriented. Typically, the cassettes support the wafers adjacent the side edges by engaging the edges below the horizontal center line of the wafer. The cassette is typically open in the bottom wall such that a portion of each wafers is exposed in that area. Typically this opening has an elongated, rectangular shape that extends beneath the row of wafers. The details of the slotted cassette construction are not illustrated since they are very well known. As noted above in connection with FIG. 1, such cleaning apparatus normally includes other structures such as plumbing for introducing the cleaning solutions, etc. but it is one of the features of the present invention that apparatus for moving the cassette laterally within the container is not needed.

Figure 8:
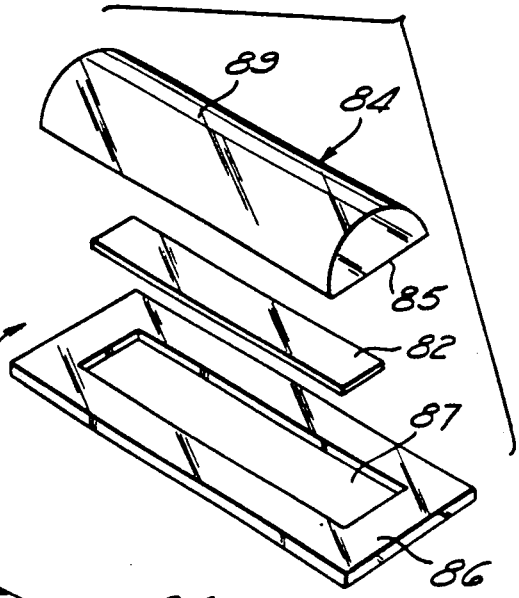
FIG. 8 is an enlarged perspective view of the transducer array of the cleaning apparatus of FIG. 7.
Figure 9:
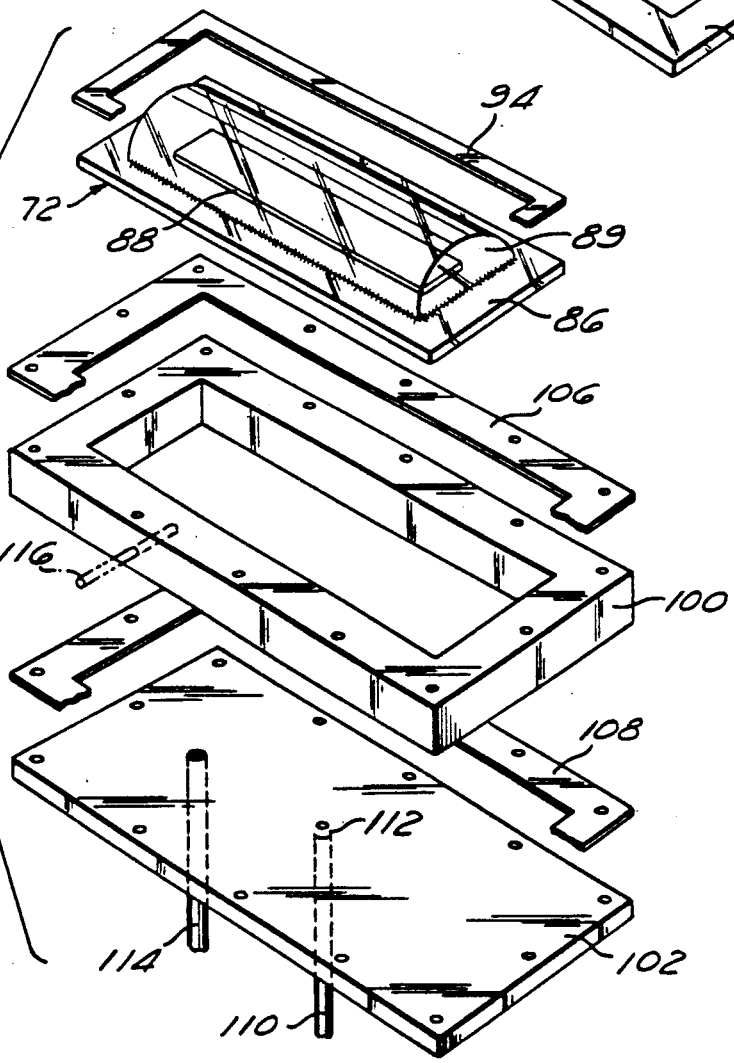
FIG. 9 is an exploded perspective view of the transducer array of FIG. 7 together with its supporting structure which also forms a cooling chamber.
Figure 10:
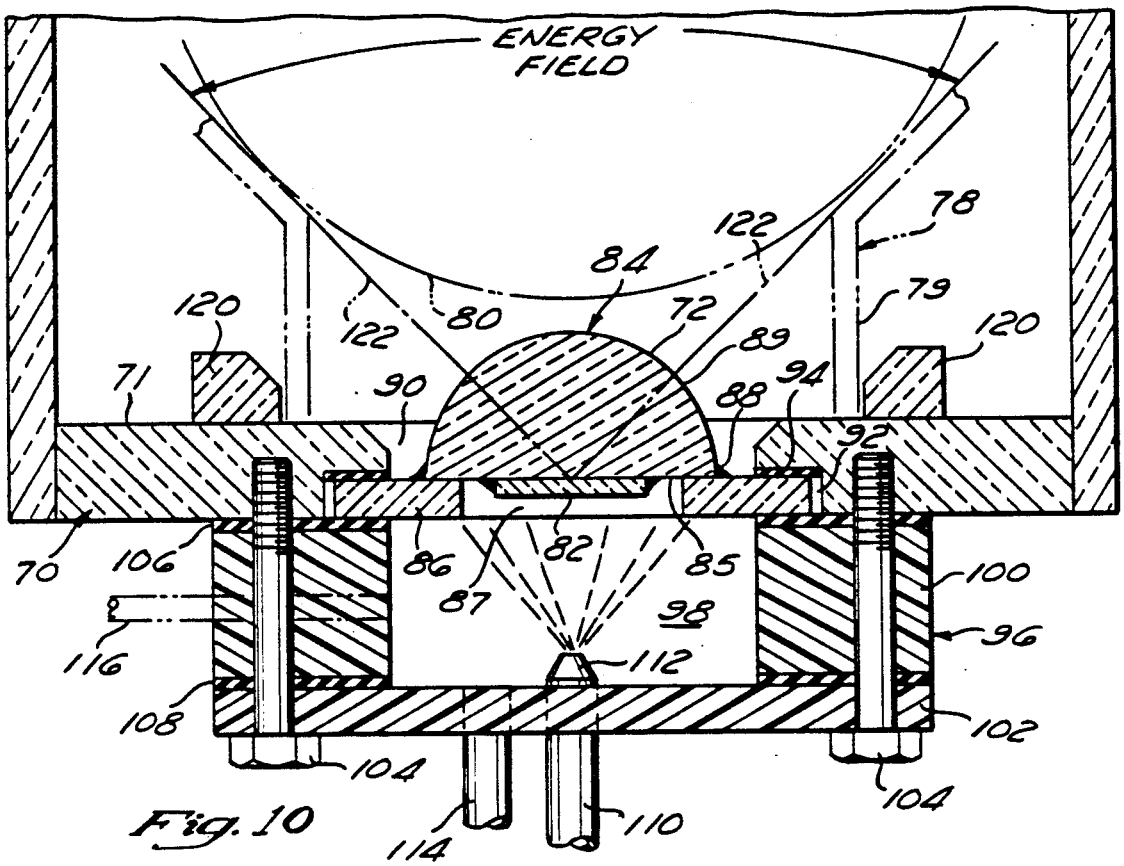
FIG. 10 is an enlarged cross-sectional view on line 10—10 of FIG. 7 schematically illustrating the cleaning apparatus in operation.

Referring to FIG. 8, the transducer array 72 includes a rectangular, flat, elongated transducer 82, an elongated semi-cylindrical energy transmitter or lens 84, and a rectangular, flat frame 86. The lens has a flat face 85 and a convex surface 89 which is symmetrically curved about a longitudinal axis centrally located on said face 85. The frame has a rectangular opening 87 therein which is larger than the transducer 82 such that the transducer is positioned within the frame when assembled, as seen in FIGS. 9 and 10. The opening 87 within the frame is slightly smaller than flat surface 85 of the transmitter 84 such that the transmitter rests on the frame 86 and is rigidly connected to the frame.

In a preferred form of the invention, the transmitter 84 and the frame 86 are made of the same material such as quartz and are joined to each other by fusing the material through heat, forming a joint 88, as schematically illustrated in FIG. 10. It would, of course, be quite satisfactory to have the transmitter 84 and the frame 86 molded or otherwise initially formed as an integral unit, if that should be more practical.

The transducer 85 is bonded by a suitable adhesive to the flat surface 85 of the transmitter in the manner described above in connection with FIGS. 1–6.

Referring to FIGS. 9 and 10, the bottom wall 71 of the container 70 has a generally rectangular opening 90 formed therein in a central location. A recess 92 is formed in the lower surface of the bottom wall 71 with the recess surrounding the opening 90. The transducer array 72 is positioned within the bottom wall opening 90 with the frame 86 positioned in the recess 92 and the lens or transmitter 84 protruding through the opening 90 and extending upwardly into the container to be close to the material to be cleaned. The inner or convex surface 89 of the transmitter 84 is therefore open to the interior of the container. Similarly, a portion of the frame adjacent the lower portion of the convex surface 89 is likewise exposed to the interior of the container. A rectangular gasket 94 made of suitable inert material is positioned between the upper surface of the outer portion of the frame 86 and the horizontal wall of the recess 92.

The transducer array 72 is held or clamped in the position shown in FIG. 10 by supporting structure 96 which also forms a chamber or cavity 98 beneath the transducer array. This supporting structure includes a rectangular housing or frame 100 having an inner rectangular opening which is smaller than the exterior dimension of the frame 86, and an outer dimension which is considerably larger. Positioned beneath the frame 100 is a bottom plate 102. The frame 100 and the plate 102 are secured to the container bottom wall by a plurality of fasteners 104 which extend through the plate and the frame, and thread into the bottom wall. Included in this stack is a suitable gasket 106 between frame 100 and the lower surface of the bottom wall 71, and a suitable rectangular gasket 108 between the lower surface of the frame 100 and the upper surface of the plate 102.

Extending through the bottom plate 102 is an inlet cooling fluid conduit 110 terminating in a nozzle 112 adapted to spray coolant onto the transducer 82. More than one nozzle may be needed to cover the entire bottom surface of the transducer, depending upon the size of the transducer and the spray pattern of the nozzle, but only one is shown for purposes of illustration. A drain conduit 114 allows the coolant to drain out of the cavity 98 so as to prevent electrical hazards. In addition, a passage 116 extends through the side frame 100 at a location spaced upwardly from the bottom wall. This passage is provided merely as a precaution in the event the lower drain becomes plugged.

The transducer 82 is similar to transducer 42 illustrated in FIG. 4, and hence is in the form of a polarized piezoelectric ceramic material with an electrically conductive coating on its upper and lower surfaces. These coatings are suitably connected to an appropriate supply of megasonic energy. For purposes of simplicity, these electrical connections are not shown in that they may be the same as shown in FIG. 4.

In operation, a cassette 78 filled with wafers 80 is positioned within the container supported on the container bottom wall. As shown in FIG. 10, a pair of guides 120 secured to the bottom wall are provided to properly position the cassette above the transducer array 72,. Appropriate cleaning solution, is positioned within the container so that the wafers are immersed in the solution. Megasonic energy is then applied to the transducer 82 causing it to vibrate together with the transmitter 84. The vibrations provided by the flat transducer are predominantly vertical in orientation hence are initially predominantely vertical within the transmitter 84. However, due to the shape of the inner surface 89 of the transmitter, the energy pattern is diffused or diverged, causing the vibrations to extend substantially radially outwardly from the transmitter 84.

The bulk of this vibrational energy is primarily directed above the transducer. The energy then diverges into the pattern or field defined by the interrupted lines 122, which in the example illustrated define an angle of about 90° equal to the angle formed by the supporting sides 79 of the cassette 78. While some energy will be transmitted out of the transmitter or lens on each side of the pattern indicated, this is a relatively minor portion. Thus, with this arrangement, it can be seen that the energy portion is such that it encompasses the entire wafer 80; whereby megasonic energy is applied adjacent to both surfaces of the vertically oriented wafers, at one time, with the pattern covering substantially the entire area of both surfaces. Consequently, it is not necessary to move the cassette transversely within the container as it had been with prior arrangements. The cassette is simply left in one position until the wafers have been subjected to sufficient megasonic energy to provide the desired cleaning caused by dislodgement of particles from the wafer surfaces.

In a prototype arrangement of the invention with which satisfactory results were obtained, 150 watts of megasonic energy was applied to a one inch by six inch transducer bonded to a semi-cylindrical transmitter having a length of seven inches and a two inch diameter. This produces about eight watts/square inch of transmitter surface area in the pattern applied to the wafers. Successful performance can be obtained from other power levels as well. It should be noted that positioning the upper surface of the transmitter close to the lower edge of the wafers 80, minimizes energy requirements. If additional energy is required to obtain the desired results, the transducer may become overheated. Hence, the cooling spray nozzle 112 is provided to control temperature. As indicated above, the coolant merely drains from the cavity 98 so as not to produce any electrical hazard. As mentioned above, the high potential side of the transducer can be safely bonded to the lens, thus leaving the long grounded side safely exposed to the coolant. The portion of the upper conductor that extends onto the end of the transducer, as in FIG. 4, can be suitably coated with an insulating material.

A preferred material for the transmitter and its supporting frame is polished quartz in that it is sufficiently inert and readily available. Sapphire is also a suitable material if it can be practically provided in the shapes needed. Another possibility for certain applications is aluminum having an anodized or protected exterior to prevent the aluminum from reacting to the cleaning solution.

Figure 11:
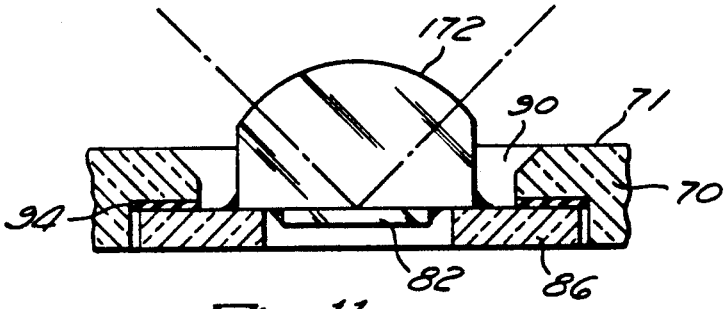
FIG. 11 is a cross-sectional view of a modified form of the energy transmitter.

FIG. 11 illustrates an alternative form of lens 172 wherein the longitudinal edges of the lens are vertical, thus in effect narrowing the width of the lens. Thus, while the lens is not semi-cylindrical, it is a portion of one, and the convex surface is a circular segment. This construction further concentrates the energy field or pattern to the desired angle illustrated, and minimizes the unproductive energy not striking the work to be cleaned.

Figure 12:
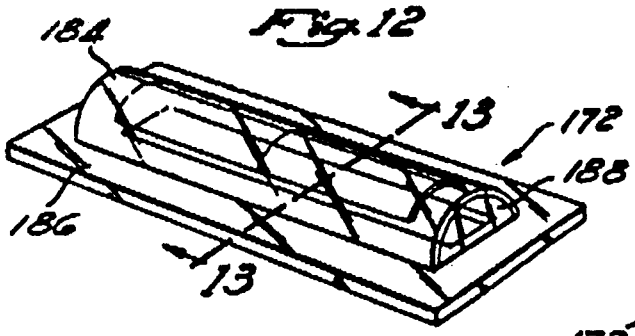
FIG. 12 is a perspective view of a transducer array employing a curved transducer and a semi-cylindrical shell as an energy transmitter.
Figure 13:
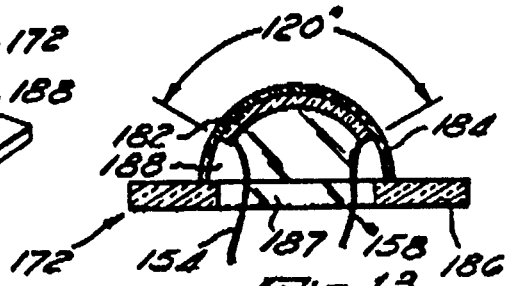
FIG. 13 is a cross-sectional view on line 13—13 of FIG. 12.

Referring now to the embodiment of FIGS. 12 and 13, there is illustrated a transducer array 172 employing a semi-cylindrical shell 184 as a megasonic energy transmitter. The lower edges of the shell are bonded to a mounting plate 186, and the shell extends over a rectangular opening 187 in the plate. The ends of the transmitter 186 are closed by semi-circular walls 188 which are bonded to the end face of each end of the shell 184, and the lower edge of each end wall 188 is also bonded to the plate.

A pair of curved transducer elements 182 are bonded to the concave surface of the transmitter 184. These transducers are mounted in end-to-end relation, spanning most of the length of the transmitter. A single transducer can be employed, but if not readily available in the desired length, shorter elements may be employed. The transducers extend through a circumferential or arcuate distance at about 120°, and are circumferentially centered with respect to the transmitter 184. Such an angle provides a pattern that easily covers the cassette of wafers to be cleaned while allowing a comfortable tolerance for misalignment or overlap. Other angles may be used as desired and is dependent on the configuration of the components to be cleaned. Electrical leads 154 and 158 are each respectively connected to an electrically conductive surface on each transducer. Such surfaces are not illustrated in FIG. 13, but are comparable to that shown in FIG. 4.

The transducer array 172 of FIGS. 12 and 13 is mounted in the bottom of a container, such as container 70 in FIG. 7, in the manner illustrated in FIGS. 7 and 9. Thus, the transducer array is essentially like that of FIGS. 7–9 with the major exceptions that transducers 182 are arcuate rather than flat and the transmitter is a cylindrical, relatively thin-walled, shell rather than a solid lens. There are a number of important advantages that flow from these structural distinctions.

The primary advantage is that with curved transducer 182 having a width the same as that of the flat transducer 82, the area of the curved transducer is, of course, greater than a flat transducer. Consequently, more power may be applied and increased, more concentrated megasonic energy is available in a given width with the arrangement of FIGS. 12 and 13 than that of FIG. 10. A flat transducer with a flat plate does not cover the wafer. Moreover, with the solid lens of FIG. 10, the energy would ideally be emanating from a single line. It is necessary to have area to provide the needed energy output. Utilizing all the space available for a flat plate transducer does not provide diverging energy paths on the edges of the lens. Thus the width selected is a compromise, and the effective energy provided is more than double with the arrangement of FIGS. 12 and 13 over the FIG. 10 arrangement. This in turn promotes more rapid cleaning of the wafers or other components to be cleaned. Further, since both the transducers and the transmitter are curved, and the transmitter has a thin wall, the megasonic energy is provided in a divergent, straight line path. By properly locating the transducer array with respect to the cassette of wafers, such as is illustrated in FIG. 10, the desired energy field is obtained to transmit megasonic energy across both flat surfaces of the wafers without moving the wafers. Note also that the transducer 182 can be closer to the wafers than the transducer 82 in FIG. 10, due to the transmitter shell.

Another advantage of the arrangement in FIGS. 12 and 13 is that quartz tubes are readily available and may be cut easily into the desired semi-cylindrical shape, or can be easily formed in that shape. Further, there is less weight for the plate 186 to support when it is mounted in the bottom wall of the container, when compared to the solid transmitter of FIG. 10. Also, with the reduced mass of the transmitter, the heat generated in the transducer array is readily conducted away by the fluid in the container, thereby eliminating the need for the cooling system shown in FIG. 10. Nitrogen or air for purging and cooling may be desirable.

Figure 14:
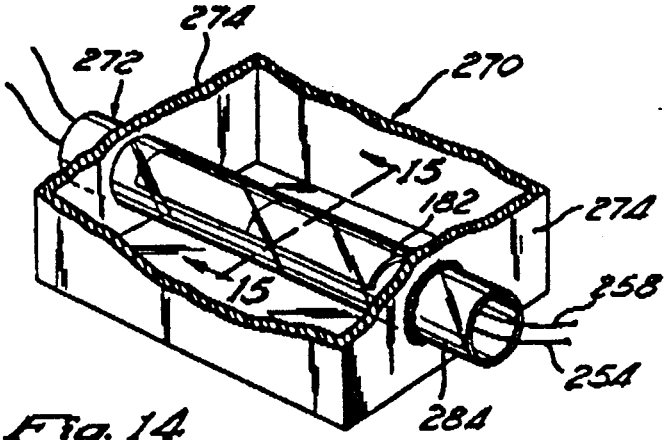
FIG. 14 is a perspective, partially cutaway, view of a transducer array employing a tube as a megasonic energy transmitter.
Figure 15:
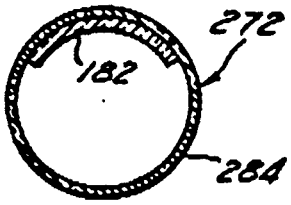
FIG. 15 is a cross-sectional view on line 15—15 of FIG. 14.

FIGS. 14 and 15 illustrate a transducer array 272 utilizing transducers 182 identical to that shown in FIGS. 12 and 13, but such transducers are bonded to the interior wall of a tubular transmitter 284. The unique advantage of this arrangement is that the tube 284 extends all the way across a container 270 with the ends of the tube extending through the side walls 272 and 274 of the container and being bonded thereto. This is a more simple mounting arrangement than that in the bottom wall of a container, as shown in the earlier embodiments. The ends of the tube are bonded or sealed directly to the walls 272 and 274 of the container without the need for the more complex cutting and sealing aspects of the mounting arrangement illustrated in FIG. 9. Also, quartz tubes are readily available. The electrical connections 254 and 258 conveniently extend out through the ends of the tube. As with the arrangement of FIGS. 12 and 13, no cooling system is needed because of the thin wall construction. The tube is shown mounted near the lower wall of the container for illustration purposes. The tube may, of course, be mounted in whatever location desired, consistent with the geometry of the components to be cleaned and the carrier for the components. Assuming the item to be cleaned would be a cassette of wafers, as in FIG. 10, a suitable support arrangement for the cassette is needed so as to position the cassette over the transducer array.

Figure 16:
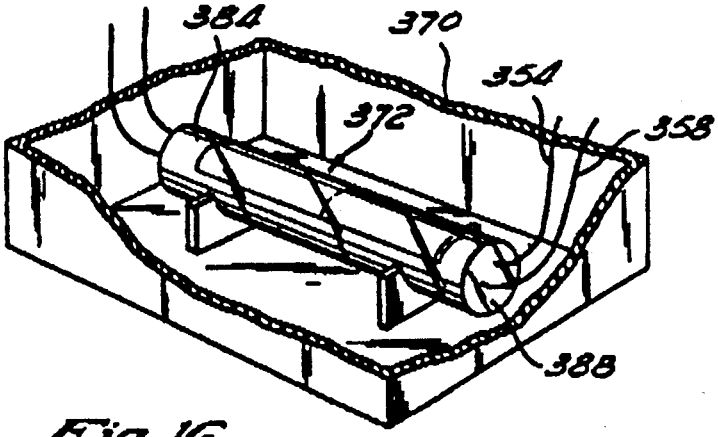
FIG. 16 is a perspective view of a transducer array employing a tubular megasonic energy transmitter removably positioned in a cleaning tank.

FIG. 16 illustrates another variation of a tubular transducer array. In this arrangement, the ends of a tube 384 are closed by circular end walls 388 so that the transducer array 372 may be positioned in a container by simply lowering it through the open upper end of a container 370, without the need for any special construction to the side walls or the bottom wall. The electrical leads 354 and 358 to the transducer will, of course, have to be suitably sealed as they pass through the ends 388 of the tube and suitably sealed from the liquid in the container. It is necessary to locate the transducer array in a desired position with respect to the articles to be cleaned. Thus, a portable or removable transducer array may be used. Like the arrangements of FIGS. 12–15, highly concentrated megasonic energy in a diverging pattern is obtained so as to efficiently provide a static cleaning system.

What I claim is:

1. A method of transmitting megasonic energy, comprising:

bonding a transducer to a surface of a transmitting device made of quartz or sapphire and having a surface on the side opposite that of the transducer adapted to direct megasonic energy in a diverging pattern; and applying megasonic energy to the transducer, causing it to transmit megasonic energy to the device and causing the device to transmit the megasonic energy in said diverging pattern.

2. The method of claim 1 including forming the device transmitting surface in a substantially semi-cylindrical configuration, causing the megasonic energy transmitted by the device to be directed generally radially outwardly from the axis of said semi-cylindrical surface.

3. The method of claim 1 wherein said transducer has a flat surface and it is that surface which is bonded in said bonding step to a flat surface of a transmitting device.

4. The method of claim 1 wherein said transducer has an arcuate convex surface and an arcuate concave surface, and said bonding step includes bonding the concave surface of said transducer to a concave surface of said transmitter, said transmitter having a convex surface which transmits the energy outwardly in a diverging pattern.

5. A method of cleaning semi-conductor wafers positioned in a carrier, the carrier having structure for receiving the side edges of the wafer so as to support the wafers in spaced, substantially parallel relation and in a substantially vertical orientation, the portions of the carrier supporting the wafers being positioned along the side edges of the wafers and the carrier being open at its bottom wall between said support portions, said method comprising:

immersing said carrier together with the wafers in a cleaning solution positioned within a container which is only slightly wider than the carrier so as to minimize the quantity of said cleaning solution needed to immerse the wafers; and applying megasonic energy into the container by energizing a transducer array positioned beneath the opening in the carrier;

said applying including transmitting the vibrational megasonic energy through a lens having a surface facing the carrier adapted to transmit the energy in a diverging pattern that enters the opening in the carrier, exposing both surfaces of the entire wafer to the energy, without moving the carrier, including those wafer portions positioned directly above the carrier portion supporting the wafers.

6. The method of claim 5, wherein said applying includes energizing a transducer having an arcuate configuration with a concave side and a convex side, said convex side being bonded to a concave side of said transmitter, with the transmitter having a convex side facing said carrier.

* * * * *

UNITED STATES PATENT AND TRADEMARK OFFICE

CERTIFICATE OF CORRECTION

PATENT NO. : 5,037,481

DATED : August 6, 1991

INVENTOR(S) : Mario E. Bran

It is certified that error appears in the above-indentified patent and that said Letters Patent is hereby corrected as shown below:

Column 12, line 19-20, "concave" should read --convex--.

Signed and Sealed this

Fourteenth Day of September, 1993

Bruce Lehman

*Attest:*

BRUCE LEHMAN

*Attesting Officer*

*Commissioner of Patents and Trademarks*

US005037481A

REEXAMINATION CERTIFICATE (2004th)

United States Patent [19]

Bran

[11] B1 5,037,481

[45] Certificate Issued May 11, 1993

[54] MEGASONIC CLEANING METHOD

[75] Inventor: Mario E. Bran, Garden Grove, Calif.

[73] Assignee: Verteq, Inc., Anaheim, Calif.

Reexamination Request:
No. 90/002,853, Oct. 2, 1992

Reexamination Certificate for:

| | |
|---|---|
| Patent No.: | **5,037,481** |
| Issued: | **Aug. 6, 1991** |
| Appl. No.: | **482,086** |
| Filed: | **Feb. 15, 1990** |

Related U.S. Application Data

[63] Continuation of Ser. No. 272,501, Nov. 6, 1988, Pat. No. 4,998,549, which is a continuation-in-part of Ser. No. 144,515, Jan. 15, 1988, Pat. No. 4,869,278, which is a continuation-in-part of Ser. No. 43,852, Apr. 29, 1987, Pat. No. 4,804,007.

[51] Int. Cl.[5] ..... B08B 9/00

[52] U.S. Cl. ..... 134/1; 134/105; 134/184; 134/201

[58] Field of Search ..... 134/1, 105, 184, 201; 366/127; 310/340, 348

[56] References Cited

U.S. PATENT DOCUMENTS

| | | | |
|---|---|---|---|
| 2,546,385 | 3/1951 | Christina | 134/89 |
| 2,565,159 | 8/1951 | Williams | 171/327 |
| 2,702,260 | 2/1955 | Massa | 134/1 |
| 2,831,785 | 4/1958 | Kearney | 134/1 |
| 2,928,069 | 3/1960 | Petermann | 340/10 |
| 3,145,312 | 8/1964 | McAuley | 310/26 |
| 3,165,049 | 1/1965 | Dick | 95/89 |
| 3,198,489 | 8/1965 | Finch | 259/1 |
| 3,229,702 | 1/1966 | Murdoch, Jr. | 134/89 |
| 3,354,495 | 11/1967 | Lawrence, III | 15/302 |
| 3,483,034 | 12/1969 | Ensminger | 134/1 |
| 3,527,607 | 9/1970 | Antonevich | 134/1 |
| 3,535,159 | 10/1970 | Shiro | 134/1 |
| 3,542,592 | 11/1970 | Zweig | 134/1 |
| 3,627,278 | 12/1971 | Dee et al. | 259/72 |
| 3,640,295 | 2/1972 | Peterson | 134/159 |
| 3,728,154 | 4/1973 | Suzuki | 134/3 |
| 3,771,772 | 11/1973 | Honda | 259/72 |
| 3,847,662 | 11/1974 | Massa | 134/1 |
| 3,849,195 | 11/1974 | Powell, Jr. et al. | 134/1 |
| 3,873,071 | 3/1975 | Tatebe | 259/72 |
| 3,893,869 | 7/1979 | Mayer et al. | 134/86 |
| 3,972,018 | 7/1970 | Erickson | 340/10 |
| 4,071,376 | 1/1978 | McNeer | 134/1 |
| 4,118,649 | 10/1978 | Shwartzman et al. | 310/337 |
| 4,183,011 | 1/1980 | Massa | 134/184 |
| 4,270,491 | 6/1981 | Daniel | 310/317 |
| 4,281,550 | 8/1981 | Erikson | 73/626 |
| 4,321,696 | 3/1982 | Kanda | 367/157 |
| 4,326,553 | 4/1982 | Hall | 134/153 |
| 4,350,917 | 9/1982 | Lizzi et al. | 310/320 |
| 4,357,173 | 11/1982 | Rosenthal et al. | 134/6 |
| 4,382,824 | 5/1983 | Halleck | 134/1 |
| 4,401,910 | 8/1983 | Beerman | 310/369 |
| 4,440,025 | 4/1984 | Hayakawa et al. | 73/642 |
| 4,444,146 | 4/1984 | De Witz et al. | 114/222 |
| 4,450,542 | 5/1984 | Kritz | 367/150 |
| 4,470,308 | 9/1984 | Hayakawa et al. | 73/642 |
| 4,605,027 | 8/1986 | Dallot | 134/108 |
| 4,607,652 | 8/1986 | Yung | 134/184 |
| 4,651,044 | 3/1987 | Kompanek | 310/323 |
| 4,651,850 | 3/1987 | Matsuo | 181/170 |
| 4,682,070 | 7/1987 | Plambeck | 310/334 |
| 4,686,406 | 8/1987 | Meitzler | 310/322 |

(List continued on next page.)

*Primary Examiner*—Patrick P. Garvin

[57] ABSTRACT

A transducer array for use in a magasonic cleaning system including a transmitter element made of a material which will efficiently transmit megasonic energy when bonded to one conductive surface of a transducer. In one form, the transmitter and the transducer are flat plates. In another form, a flat transducer is bonded to a solid semi-cylindrical transmitter which causes the megasonic energy pattern to diverge. In another form, the transmitter is a semi-cylindrical shell or is tubular, and the transducer is bonded to and curved to conform to the transmitter. The transducer extends about 120°, and produces a straight line of sight diverging energy pattern.

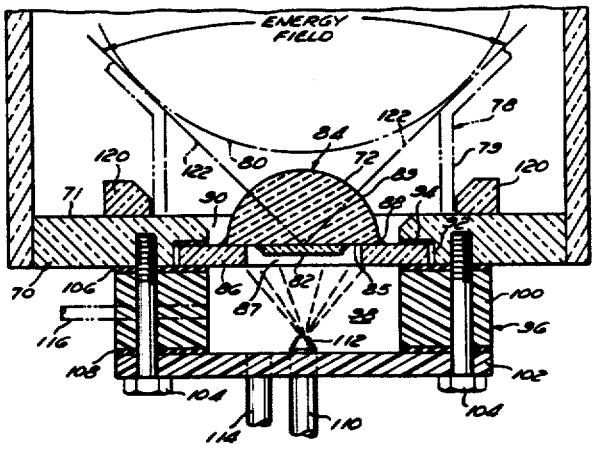

U.S. PATENT DOCUMENTS

| | | | |
|---|---|---|---|
| 4,691,724 | 9/1987 | Garcia et al. | 134/169 |
| 4,691,725 | 9/1987 | Parisi | 134/184 |
| 4,697,605 | 10/1987 | Yung | 134/107 |
| 4,740,248 | 4/1988 | Thro et al. | 134/21 |
| 4,751,529 | 6/1988 | Elrod et al. | 346/140 |
| 4,821,244 | 4/1989 | Wood | 367/159 |
| 4,823,041 | 4/1989 | Inoue et al. | 310/322 |
| 4,854,337 | 8/1989 | Bunkenburg et al. | 134/184 |
| 4,872,965 | 10/1989 | Pankow | 204/299 |
| 4,962,332 | 10/1990 | Rokurohta et al. | 73/632 |
| 4,967,873 | 11/1990 | Hacchow et al. | 181/176 |
| 5,037,208 | 8/1991 | Dussault et al. | 366/127 |
| 5,119,840 | 6/1992 | Shibata | 134/184 |

FOREIGN PATENT DOCUMENTS

| | | |
|---|---|---|
| 526057 | 5/1931 | Fed. Rep. of Germany . |
| 1036602 | 3/1957 | Fed. Rep. of Germany . |
| 46-7105 | 3/1971 | Japan . |
| 1015962 | 1/1966 | United Kingdom . |
| 2165330A | 10/1984 | United Kingdom . |

OTHER PUBLICATIONS

Schwartzman et al., "Megasonic Particle Removal from Solid-State Wafers", RCA Review, vol. 46, Mar., 1985, pp. 81-105.

Spring, Metal Cleaning, Reinhold Publication Corp. New York, 1963.

"Ultrasonic Cleaning in the Lucas Group", Daw., Dig. (6B) vol. 13, No. 4, pp. 3-4, 1970.

Kern, "The Evolution of Silicon Wafer Cleaning Technology", J. Electrochemical Soc., vol. 137, No. 6, Jun., 1990.

Kern, "Purifying Si and $SiO_2$ Surfaces with Hydrogen Peroxide", Semiconductor International, Apr., 1984.

Kern, "Hydrogen Peroxide Solutions for Silicon Wafer Cleaning", RCA Engineer, Jul.-Aug., 1983.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-5 is confirmed.

Claim 6 is determined to be patentable as amended.

New claims 7-11 are added and determined to be patentable.

6. The method of claim 5, wherein said applying includes energizing a transducer having an arcuate configuration with a concave side and a convex side, said convex side being bonded to a concave side of said

[transmitter] *lens*, with the [transmitter] *lens* having a convex side facing said carrier.

*7. The method of claim 5, wherein said applying includes transmitting the megasonic energy through a lens forming a segment of a tube.*

*8. The method of claim 5, wherein said applying includes energizing a transducer having an arcuate configuration with a concave side and a convex side, and wherein said lens comprises a tubular transmitter coupled to the convex side of the transducer such that megasonic energy is transmitted through the tubular transmitter in substantially a straight line but diverging pattern.*

*9. The method of claim 5, wherein said applying includes energizing a transducer having an arcuate configuration with a concave side and a convex side, and includes transmitting the megasonic energy through an arcuate lens coupled to said convex side.*

*10. The method of claim 5, wherein said applying includes energizing a transducer in the form of a cylindrical segment and transmitting a diverging pattern of energy through a lens in the form of a cylindrical segment.*

*11. The method of claim 1, wherein said applying includes energizing a transducer having an arcuate configuration with a concave side and a convex side and wherein said device comprises a tubular transmitter coupled to the convex side of the transducer such that megasonic energy is transmitted through the tubular transmitter in substantially a straight line but diverging pattern.*

* * * * *